US007605642B2

(12) United States Patent
Kumar et al.

(10) Patent No.: US 7,605,642 B2
(45) Date of Patent: Oct. 20, 2009

(54) GENERIC VOLTAGE TOLERANT LOW POWER STARTUP CIRCUIT AND APPLICATIONS THEREOF

(75) Inventors: Pankaj Kumar, Karnatka (IN); Pramod Elamannu Parameswaran, Karnataka (IN); Anuroop Iyengar, Karnataka (IN)

(73) Assignee: LSI Corporation, Milpitas, CA (US)

( * ) Notice: Subject to any disclaimer, the term of this patent is extended or adjusted under 35 U.S.C. 154(b) by 0 days.

(21) Appl. No.: 11/951,381

(22) Filed: Dec. 6, 2007

(65) Prior Publication Data

US 2009/0146728 A1 Jun. 11, 2009

(51) Int. Cl.
*G05F 1/10* (2006.01)

(52) U.S. Cl. ..... 327/538; 323/312

(58) Field of Classification Search ..... None
See application file for complete search history.

(56) References Cited

U.S. PATENT DOCUMENTS

| | | | | |
|---|---|---|---|---|
| 4,890,052 | A * | 12/1989 | Hellums | 323/315 |
| 5,751,142 | A * | 5/1998 | Dosho et al. | 323/316 |
| 6,191,644 | B1 * | 2/2001 | Srinath et al. | 327/539 |
| 6,351,111 | B1 * | 2/2002 | Laraia | 323/315 |
| 6,356,064 | B1 * | 3/2002 | Tonda | 323/313 |
| 6,498,528 | B2 * | 12/2002 | Inagaki et al. | 327/541 |
| 6,559,709 | B2 * | 5/2003 | Rolandi et al. | 327/537 |
| 6,600,361 | B2 * | 7/2003 | Nagaya et al. | 327/538 |
| 6,677,810 | B2 * | 1/2004 | Fukui | 327/541 |
| 6,933,769 | B2 * | 8/2005 | Koelling | 327/538 |
| 7,208,929 | B1 * | 4/2007 | Rabeyrin et al. | 323/313 |
| 7,348,830 | B2 * | 3/2008 | Debroux | 327/538 |
| 2006/0232255 | A1 | 10/2006 | Haider et al. | |
| 2007/0164722 | A1 * | 7/2007 | Rao et al. | 323/315 |

OTHER PUBLICATIONS

Khan, Q. A., et al.; *Low Power Startup Circuits for Voltage and Current Reference With Zero Steady State Current*; ISLPED '03 (ACM); Aug. 2003; pp. 184-188.

* cited by examiner

*Primary Examiner*—Lincoln Donovan
*Assistant Examiner*—Thomas J Hiltunen
(74) *Attorney, Agent, or Firm*—Duft Bornsen & Fishman LLP

(57) ABSTRACT

Circuits and systems including a startup circuit coupled to a reference source for providing startup current to the reference source wherein no transistor of the startup circuit experiences a stress condition and wherein the startup circuit consumes no static current following stabilized, steady-state operation of the reference source.

3 Claims, 4 Drawing Sheets

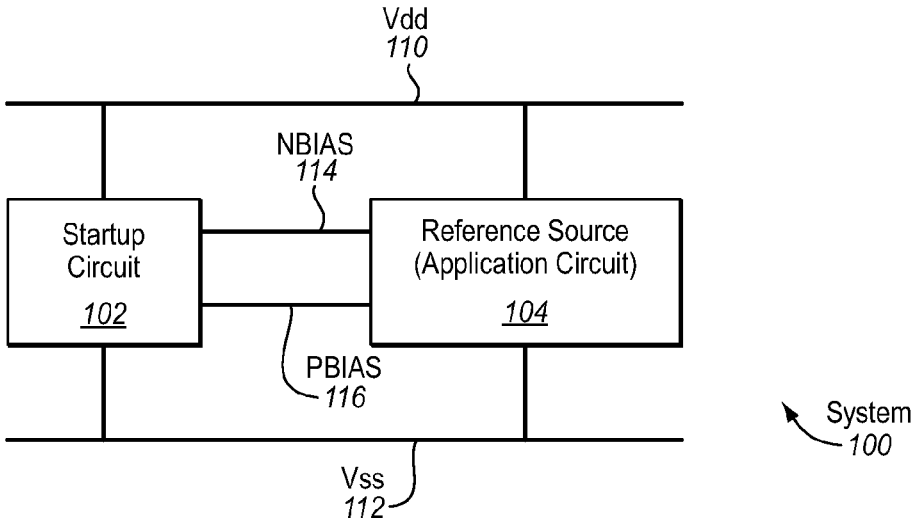
FIG. 1
PRIOR ART
FIG. 2
PRIOR ART
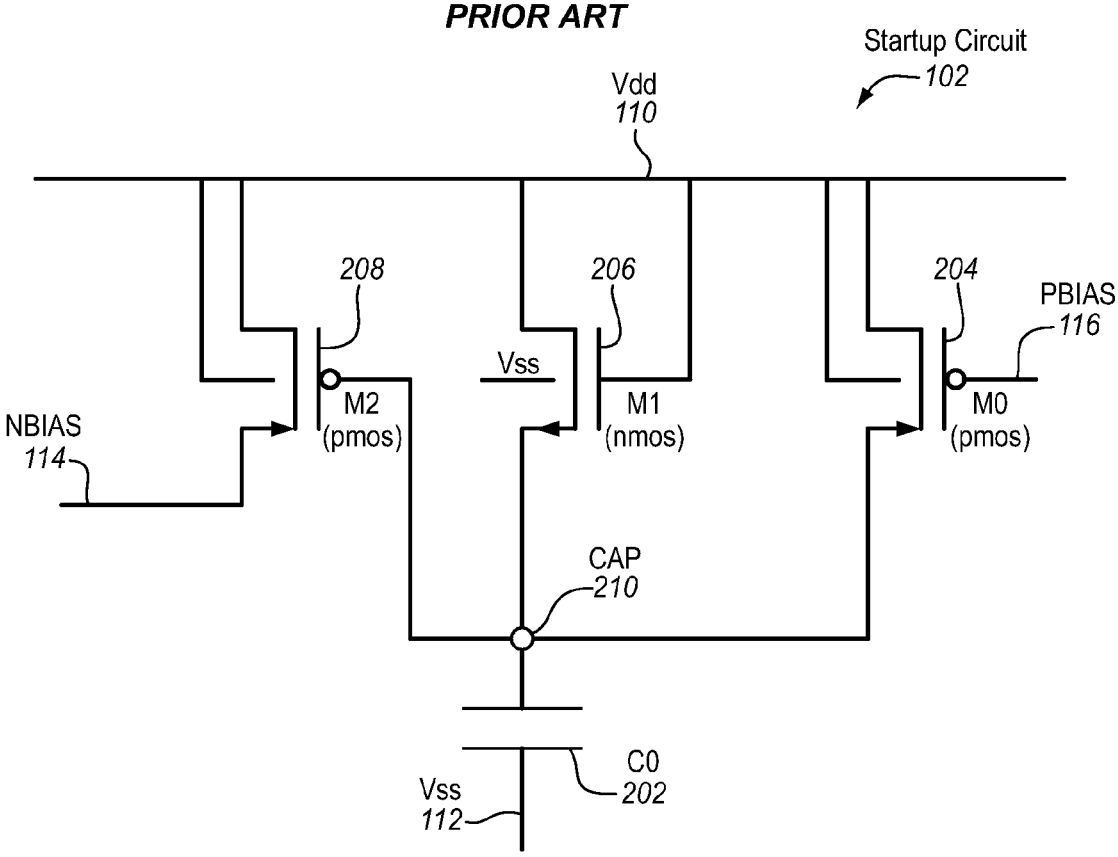

GENERIC VOLTAGE TOLERANT LOW POWER STARTUP CIRCUIT AND APPLICATIONS THEREOF

BACKGROUND

1. Field of the Invention

The invention relates generally to a startup circuit as used to commence operation of a reference voltage source in a circuit design and more specifically relates to a startup circuit design that uses transistors operating at a lower voltage level than the provided Vdd and that operates to consume no static power after the reference source has reached normal operating parameters and that operates to avoid stressing any of the transistors in the startup circuit.

2. Discussion of Related Art

It is common in a variety of electronic application designs to provide a reference voltage source for generating one or more reliable voltage levels (e.g., NBIAS and/or PBIAS) for use within the application circuit. The reference source derives its operating power and generates the reference voltage from a ubiquitous power supply source in the application (e.g., Vdd voltage level and a corresponding Vss often ground or zero volts). Those of ordinary skill in the art will recognize that a reference source may also be used to generate a constant source of precise current for some applications. The problems discussed below and the solutions provided by features and aspects hereof are similarly applicable to such a reference current source.

Typical reference source designs may not start operating by simple application of Vdd thereto depending on a number of design and environmental conditions. It is generally known in the design of reference sources that a startup circuit is required to transition the reference voltage from an inoperable or dead state to a normal, steady-state, operating state providing the stable, desired reference voltage levels. It is desirable that such a startup circuit consumes no power/current once the reference source has achieved its desired, normal, stable operating state. This is particularly desirable in low power electronic applications where conservation of electrical power is critical such as in remote process control applications and a variety of portable electronic applications.

A variety of startup circuits are well known as evidenced, for example, in: "Low Power Startup Circuits For Voltage and Current Reference with Zero Steady State Current" (Khan, et al.; ISLPED '03 Conference Proceedings; ACM; pp. 184-188, 2003). In particular, Khan describes two general varieties of startup circuits—a first that operates responsive to a power-up/power-down signal and a second responsive to the ramp up of Vdd provided ubiquitously in the application from power up of the common power supply.

Khan presents one particular exemplary embodiment in his FIG. 4 that describes a startup circuit operable responsive to ramp up of Vdd and configured to consume no static power following commencement of normal, steady state, operation of the reference source.

In older application designs, the various components (e.g., transistors) of the application operated at the voltage levels of the ubiquitous Vdd power supply. In more modern or low voltage applications, it is common that low voltage devices (e.g., transistors and other components) of the application circuit operate at a higher voltage domain. Hence, where Vdd may exceed the operating parameters of transistors of the startup circuit, startup circuits such as those exemplified by Khan may stress the transistors of the startup circuit causing immediate or eventual failure.

It is evident from the above discussion that a need exists for an improved startup circuit design that avoids applying stress conditions to any of the transistors of the startup circuit while providing flexibility and low power consumption of prior designs.

SUMMARY

The present invention solves the above problems, thereby advancing the state of the useful arts, by providing systems and circuits including a startup circuit adapted for coupling to a reference source wherein the startup circuit may operate using lower voltage transistors than the ubiquitous Vdd source voltage, wherein the startup circuit consumes no current following establishment of a steady state operation of the reference source, and wherein the startup circuit is protected from stress conditions applied to any of its transistors.

One aspect hereof provides an apparatus including a power supply providing Vss and Vdd, a reference voltage source coupled to Vss and Vdd for generating a reference voltage signal (NBIAS), and a startup circuit coupled to Vss and Vdd and coupled to the reference voltage source to generate a startup signal applied to the reference voltage source to initiate operation of the reference voltage source. The startup circuit comprises a transistor having a maximum gate-source voltage ("stress voltage") less than Vdd-Vss. The startup circuit is configured to consume no static current once the reference voltage source reaches its normal operating state. The startup circuit is configured to never generate a stress voltage in any of its transistors.

Another aspect hereof provides a startup circuit adapted for coupling to a reference voltage source. The startup circuit includes a fence capacitor (C0) coupled to a Vss voltage source and coupled to a node (CAP). The startup circuit further includes a first pmos transistor (M0) having its gate coupled to a signal (PBIAS) generated by the reference voltage source and having its source coupled to a Vdd voltage source and having its drain coupled to CAP, wherein PBIAS follows Vdd due to parasitic resistance within the reference voltage source. The startup circuit further includes a second pmos transistor (M1) having its gate diode coupled to CAP and having its source coupled to Vdd and having its drain coupled to CAP. The startup circuit further includes a third pmos transistor (M2) having its gate coupled to CAP and having its source coupled to Vdd and having its drain coupled to the reference voltage source to start current flow in the NBIAS signal path of the reference voltage source. The startup circuit is configured to apply a startup current to NBIAS in response to ramping up of Vdd. The startup circuit is configured to consume no static current once the reference voltage source reaches its normal operating state. The startup circuit is configured to never generate a stress voltage in M1.

BRIEF DESCRIPTION OF THE DRAWINGS

FIG. 1 is a block diagram of a typical startup circuit as used with a reference source as presently practiced in the art.

FIG. 2 is a circuit diagram of an exemplary startup circuit as presently practiced in the art.

DETAILED DESCRIPTION OF THE DRAWINGS

Figure 4:
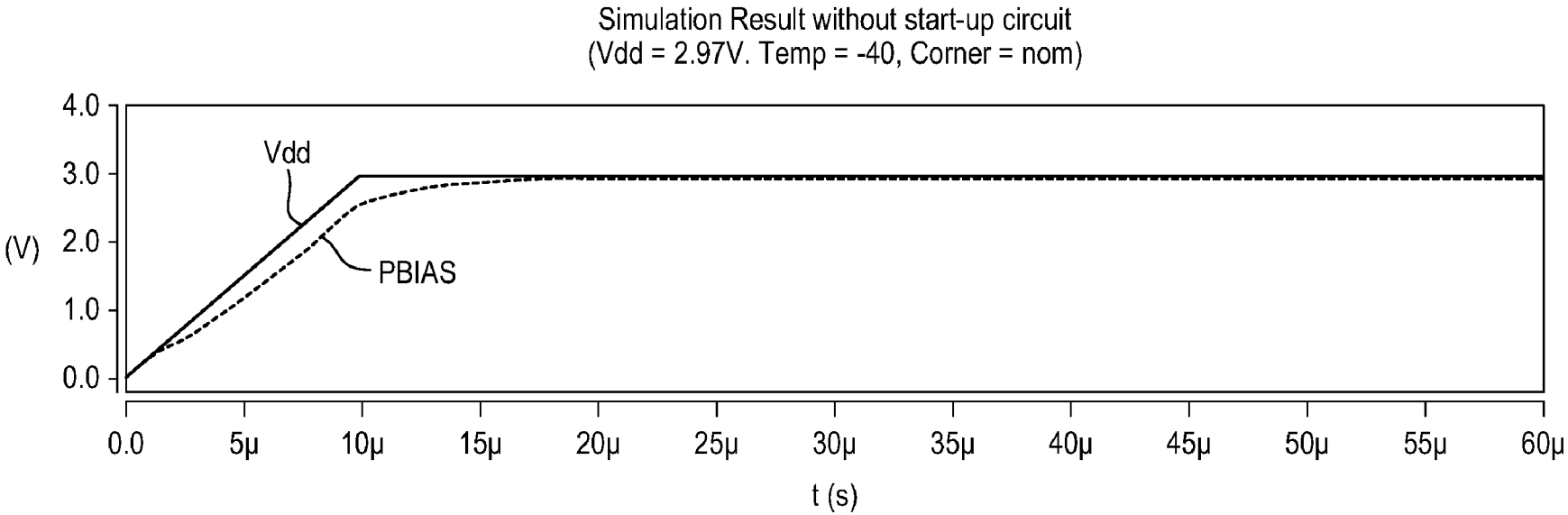
FIG. 4 PRIOR ART
FIG. 4 is a simulated waveform display indicating typical ramp up of Vdd and PBIAS signals in a reference source devoid of the startup circuit

FIGS. 1, 2, and 4 relate to typical reference sources with typical startup circuits as presently practiced in the art. In particular, FIG. 2 represents the startup circuit presented in the Khan paper noted above.

FIG. 1 is a block diagram depicting a system 100 including a startup circuit 102 coupled to Vdd 110 and to Vss 112. Startup circuit 102 is also coupled to a reference source (application circuit) 104 via NBIAS 114 and PBIAS 116 (both signals generated within typical reference voltage sources). Reference source 104 is also coupled to Vdd 110 and Vss 112. In general, any startup circuit 102 as presently known in the art may provide a startup current typically applied to NBIAS 114 to stimulate operation of the reference voltage source 104.

FIG. 2 is a circuit diagram corresponding to the above mentioned exemplary embodiment of Khan. In operation, startup circuit 102 of FIG. 2 starts with power off and hence Vdd 110, NBIAS 114, PBIAS 116, and CAP node 210 are all at zero volts and thus no current flows through the startup circuit 102. As Vdd 110 starts ramping up at power-on, PBIAS 116 starts following Vdd 110 due to parasitic resistance typical between the two signals within most reference source designs. As Vdd 110 exceeds the turn on threshold voltage of M1 206 (an nmos transistor) M1 turns on and starts charging the node CAP 210 and capacitor C0 202. The time constant for charging the capacitor C0 202 depends on the channel resistance of transistor M1 206 and the capacitance value of capacitor C0 202. Since the rate of charging of capacitor C0 202 will be less than the rate of increase of Vdd 110, the gate to source voltage of transistor M2 208 (a pmos transistor) starts pulling the NBIAS signal 114 towards Vdd 110 thus generating a startup current in the reference source. As is common in a typical reference source design, the startup flow of current in reference source starts discharging PBIAS 116 such that it no longer follows Vdd 110. Transistor M1 206 is diode connected and hence provides further charging of capacitor C0 202 up to the maximum voltage of Vdd minus the threshold voltage of transistor M1 206. This additional charging keeps transistor M2 208 turned on to continue the flow of startup current into NBIAS 114 of the reference source. As Vdd 110 reaches its stable value, the levels of NBIAS 114 and PBIAS 116 generated by the reference source will also eventually attain their respective stable, steady state, normal operating values. The discharged value of PBIAS 116 turns on transistor M0 204 (a pmos transistor) which, in turn, pulls node CAP 210 all the way to Vdd thus turning off both transistors M1 206 and M2 208. Thus once the reference source settles at its desired, normal, steady state operating level, the startup circuit 102 turns off consuming no static DC current.

FIG. 4 shows a simulated waveform representing the ramp up of Vdd 110 and the corresponding following ramping of PBIAS 116 without any startup circuit. Eventually, when the reference source reaches steady-state operation, PBIAS (and NBIAS) will reach their respective steady-state levels in general, in such steady-state operation, PBIAS will stabilize at a voltage below Vdd.

As noted above, the startup circuit 102 of FIG. 2 can fail if the gate to source voltage on M1 206 exceeds the design threshold of the fabricated transistor. This failure occurs in startup circuits where the Vdd level significantly exceeds the design specifications of the transistors of the startup circuit. In particular, for example, if M0, M1, and M2 are 1.8 volt transistors and Vdd is about 3 volts (e.g., 3.3 volt design), the gate to source voltage across M2 may exceed the design parameters of the transistor—i.e., may generate a stress voltage in the transistor and cause failure of the circuit.

Figure 3:
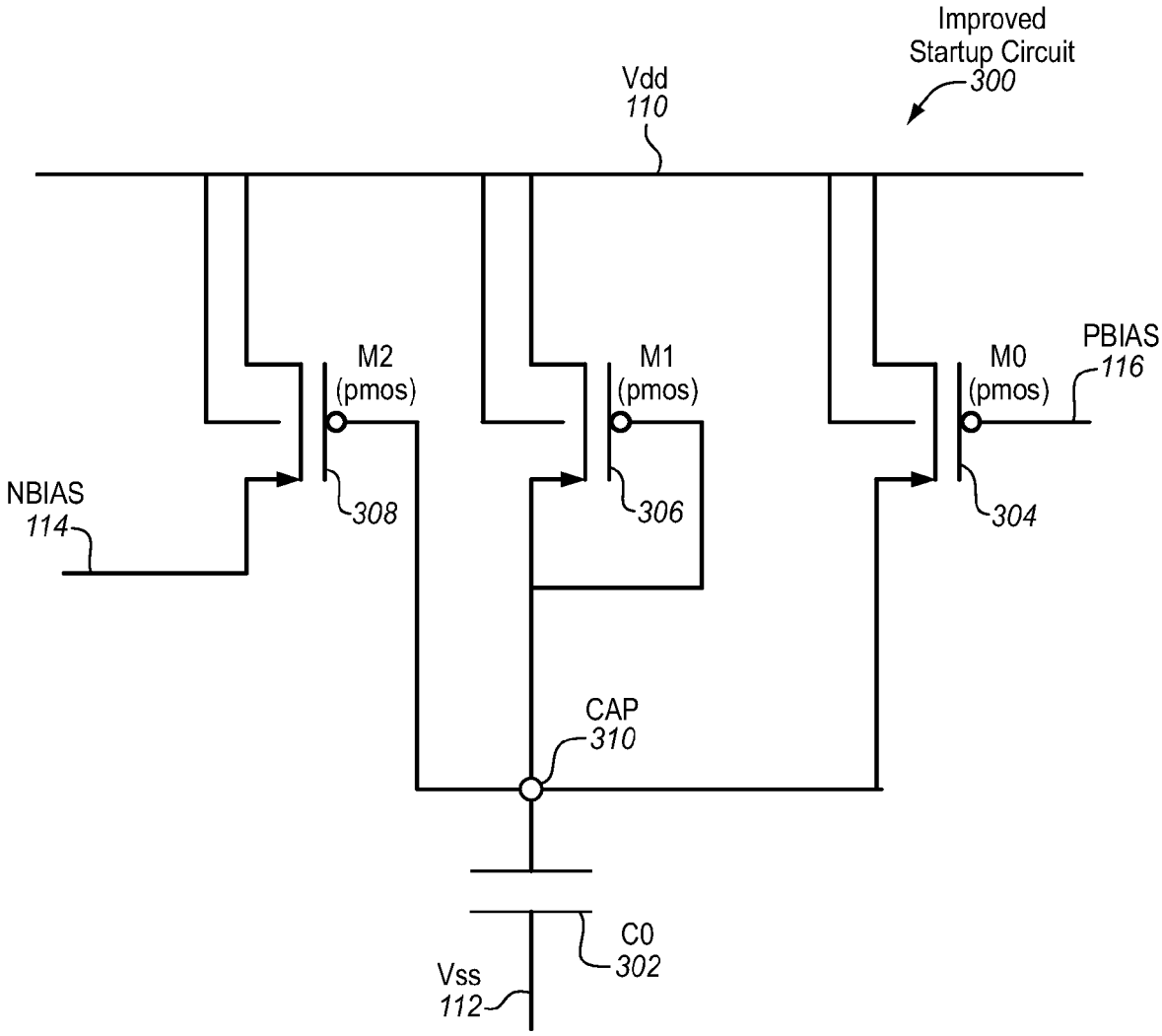
FIG. 3 is a circuit diagram of an exemplary circuit in accordance with features and aspects hereof wherein the startup circuit consumes no current following establishment of steady state operation of the associated reference source and further permits the use of lower voltage transistors as compared to the voltage level of he ubiquitous Vdd signal while avoiding stress conditions on any of the low voltage transistors.

By contrast, FIG. 3 is a circuit diagram of an exemplary embodiment of an improved startup circuit 300 in accordance with features and aspects hereof. As in FIG. 2, transistors M0 304 and M2 208 are both pmos transistors configured and coupled similarly to M0 204 and M2 208, respectively, of FIG. 2. In like manner fence capacitor C0 302 is coupled to Vss 112 and node CAP 310 identically to capacitor C0 202 of FIG. 2.

M1 306, unlike M1 206 of FIG. 2, is a pmos transistor having its gate diode coupled with the drain thereof to node CAP 310. The source of M1 306 is coupled to Vdd 110.

At start of operation of enhanced startup circuit 300, Vdd, PBIAS, NBIAS, and node CAP are all discharged to ground. Vdd is ramped from a power-on condition and PBIAS starts the following Vdd due to typical parasitic resistance within the design of the reference source. As Vdd starts increasing, the diode connected transistor M1 306 will start conducting. Since transistor M2 308 is mirrored to M1 306, it will also start charging thereby providing startup current to the reference source (via NBIAS 114). A fence capacitor C0 302 stores the charge of node CAP. As NBIAS continues to rise the reference source will start pushing PBIAS to its steady-state value such that it no longer follows Vdd. Finally, PBIAS will settle at its steady-state value less then Vdd. Since M1 306 is diode connected, it will charge node CAP up to Vdd minus the threshold voltage of M1 306. As the reference source eventually stabilizes in its normal, steady-state operating mode, PBIAS discharge such that conduction will start through transistor M0 304 coupled to PBIAS 116 at its gate. M0 304 will thus continue to charge node CAP (and C0 302) up to Vdd. With node cap held at Vdd by the charge stored in the capacitor C0 302, transistor M1 306 will never experience a stress condition—neither will transistor M0 304 or transistor M2 308.

Figure 5:
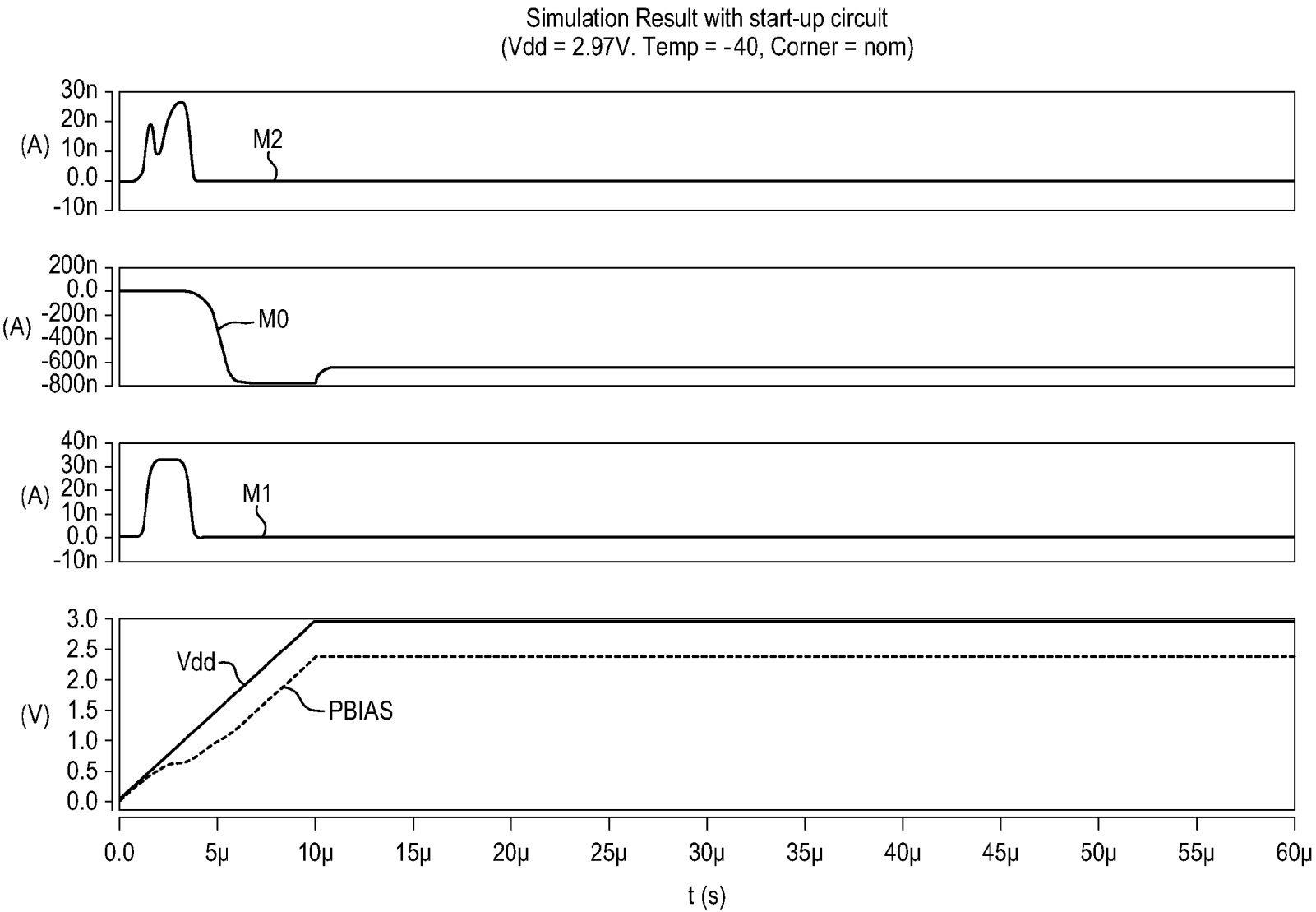
FIG. 5 is a simulated waveform indicating the modified ramping of Vdd and PBIAS signals in accordance with features and aspects hereof as well as indicating a simulated representation of current draw was transistors of the exemplary startup circuit of FIG. 3.

FIG. 5 shows simulated waveforms indicating PBIAS node discontinuing its following of Vdd as the reference source begins to stabilize. As noted above, PBIAS will reach its steady-state level, typically below Vdd, as the reference source attains its steady-state, normal operation levels. Also shown in FIG. 5 is a simulated waveform representation of the lack of current flow in transistor M2 308 of FIG. 3 following the stabilized operation of the reference source.

Thus, improved startup circuit 300 of FIG. 3 is one exemplary embodiment of an improved startup circuit allowing use of lower voltage transistors in its design regardless of the level of Vdd while avoiding stress conditions applied to any of the transistors in the startup circuit. Further, the circuit of FIG. 3 stops current flow through the startup circuit following stabilized normal operation of the associated reference source.

While the invention has been illustrated and described in the drawings and foregoing description, such illustration and description is to be considered as exemplary and not restrictive in character. One embodiment of the invention and minor variants thereof have been shown and described. Protection is desired for all changes and modifications that come within the spirit of the invention. Those skilled in the art will appreciate variations of the above-described embodiments that fall within the scope of the invention. As a result, the invention is not limited to the specific examples and illustrations discussed above, but only by the following claims and their equivalents.

What is claimed is:

1. Apparatus comprising:

a power supply providing Vss and Vdd;

a reference voltage source coupled to Vss and Vdd for generating a reference voltage signal (NBIAS); and a startup circuit coupled to Vss and Vdd and coupled to the reference voltage source to generate a startup signal applied to the reference voltage source to initiate operation of the reference voltage source, wherein the startup circuit is configured to consume no static current once the reference voltage source reaches its normal operating state, and wherein the startup circuit is configured to never generate a stress voltage in any of its transistors, wherein the startup circuit comprises:

a fence capacitor (C0) coupled to Vss and coupled to a node (CAP);

a first pmos transistor (M0) having its gate coupled to a signal (PBIAS) generated by the reference voltage source and having its source coupled to Vdd and having its drain coupled to CAP, wherein PBIAS follows Vdd due to parasitic resistance within the reference voltage source;

a second pmos transistor (M1) having its gate diode coupled to CAP and having its source coupled to Vdd and having its drain coupled to CAP;

a third pmos transistor (M2) having its gate coupled to CAP and having its source coupled to Vdd and having its drain coupled to the reference voltage source to start current flow in the NBIAS signal path of the reference voltage source; and wherein at least one of the first, second and third PMOS transistors has a maximum gate-source voltage ("stress voltage") less than Vdd-Vss.

2. A startup circuit adapted for coupling to a reference voltage source, the startup circuit comprising:

a fence capacitor (C0) coupled to a Vss voltage source and coupled to a node (CAP);

a first pmos transistor (M0) having its gate coupled to a signal (PBIAS) generated by the reference voltage source and having its source coupled to a Vdd voltage source and having its drain coupled to CAP, wherein PBIAS follows Vdd due to parasitic resistance within the reference voltage source;

a second pmos transistor (M1) having its gate diode coupled to CAP and having its source coupled to Vdd and having its drain coupled to CAP; and a third pmos transistor (M2) having its gate coupled to CAP and having its source coupled to Vdd and having its drain coupled to the reference voltage source to start current flow in the NBIAS signal path of the reference voltage source, wherein the startup circuit is configured to apply a startup current to NBIAS in response to ramping up of Vdd, wherein the startup circuit is configured to consume no static current once the reference voltage source reaches its normal operating state, wherein the startup circuit is configured to never generate a stress voltage in M1, and wherein at least one of the M0, M1 and M2 has a maximum gate-source voltage ("stress voltage") less than Vdd-Vss.

3. The startup circuit of claim 2 wherein transistors M0, M1, and M2 all have a maximum gate-source voltage ("stress voltage") less than Vdd-Vss, and wherein the startup circuit is configured to never generate a stress voltage in M0 or M1 or M2.

* * * * *